US009784232B1

(12) United States Patent
Marrs et al.

(10) Patent No.: US 9,784,232 B1
(45) Date of Patent: Oct. 10, 2017

(54) FORCED FREQUENCY IGNITION SYSTEM FOR AN INTERNAL COMBUSTION ENGINE

(71) Applicant: MARSHALL ELECTRIC CORP., Rochester, IN (US)

(72) Inventors: Thomas C. Marrs, Rochester, IN (US); Stephen P. Barlow, Carmel, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 0 days.

(21) Appl. No.: 15/088,945

(22) Filed: Apr. 1, 2016

(51) Int. Cl.

| | |
|---|---|
| ***F02P 9/00*** | (2006.01) |
| ***F02B 5/00*** | (2006.01) |
| ***F02P 3/04*** | (2006.01) |
| ***H01T 13/04*** | (2006.01) |
| ***H01T 15/00*** | (2006.01) |

(52) U.S. Cl.
CPC ..... *F02P 9/002* (2013.01); *F02B 5/00* (2013.01); *F02P 3/0435* (2013.01); *H01T 13/04* (2013.01); *H01T 15/00* (2013.01)

(58) Field of Classification Search
CPC .... F02P 9/002; F02P 9/00; F02P 9/007; F02P 3/04; F02P 3/0407; F02P 3/0442
USPC ..... 123/406.12, 606, 607, 621, 622
See application file for complete search history.

(56) References Cited

U.S. PATENT DOCUMENTS

| | | | | |
|---|---|---|---|---|
| 3,563,221 | A * | 2/1971 | Tada | F02P 3/0838 123/598 |
| 4,451,774 | A * | 5/1984 | Akita | H02J 7/1461 320/123 |
| 4,998,526 | A | 3/1991 | Gokhae | |
| 5,806,504 | A | 9/1998 | French et al. | |
| 5,886,476 | A * | 3/1999 | Skinner | F02P 17/12 123/621 |
| 6,135,099 | A | 10/2000 | Marrs | |
| 2012/0079956 | A1 * | 4/2012 | Jurras, III | F42B 3/18 102/202.7 |

* cited by examiner

*Primary Examiner* — Mahmoud Gimie
(74) *Attorney, Agent, or Firm* — Egbert Law Offices, PLLC

(57) ABSTRACT

An ignition system for an internal combustion engine has a power source, a transformer having first and second primary windings and a secondary winding, a connector extending from the secondary winding and adapted so as to connect with a terminal of the spark plug of the internal combustion engine, and electronic spark timing circuit cooperative with the transformer so as to activate and deactivate voltage to the first and second primary windings. The first and second primary windings are connected to the power source such that the transformer produces an alternating voltage output from the secondary winding of between 1 kHz and 100 kHz and a voltage of at least 20 kV. A forced push-pull inverter is cooperative with the electronic spark timing circuit so as to fix a frequency of voltage to the first and second primary windings.

17 Claims, 4 Drawing Sheets

FORCED FREQUENCY IGNITION SYSTEM FOR AN INTERNAL COMBUSTION ENGINE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to internal combustion engines. More particularly, the present invention relates to electrical ignition apparatus that are used for the igniting the fuel within the internal combustion engine. More particularly, the present invention relates to ignition coils which apply an AC voltage for the ignition of the spark plug within the internal combustion engine.

2. Description of Related Art Including Information Disclosed Under 37 CFR 1.97 and 37 CFR 1.98

Most internal combustion engines have some type of an ignition circuit to generate a spark in the cylinder. The spark causes combustion of the fuel in the cylinder to drive the piston and the attached crankshaft. Typically, the engine includes a plurality of permanent mount magnets mounted on the flywheel of the engine and a charge coil mounted on the engine housing in the vicinity of the flywheel. As the flywheel rotates, the magnets pass the charge coil. A voltage is thereby generated on the charge coil and this voltage is used to charge a high-voltage capacitor. The high-voltage charge on the capacitor is released to the ignition coil by way of a triggering circuit so as to cause a high-voltage, short-duration electrical spark across the spark gap of the spark plug and ignite the fuel in the cylinder. This type of ignition is called a capacitive discharge ignition.

The design of standard reciprocating internal combustion engines which use ignition coils to initiate combustion have, for years, utilized combustion chamber shapes and spark plug placements which were heavily influenced by the need to reliably initiate combustion using only a single short-duration spark having a relatively low intensity. In recent years, however, increased emphasis has been placed on fuel efficiency, completeness of combustion, exhaust cleanliness, and reduced variability in cycle-to-cycle combustion. This emphasis has meant that the shape of the combustion chamber must be modified and the ratio of the fuel-air mixture changed. In some cases, a procedure has been used which deliberately introduces strong turbulence or a rotary flow of the fuel-air mixture at the area where the spark plug electrodes are placed. This often causes an interruption or "blowing out" of the arc. This has placed increasing demands on the effectiveness of the combustion initiation process. It is been found highly preferable, in such applications, to have available an arc which may be sustained for as much as four to five milliseconds. Efforts to effectuate this idea have resulted in various innovations identified in several patents.

For example, U.S. Pat. No. 5,806,504, issued on Sep. 15, 1998 to French et al., teaches an ignition circuit for an internal combustion engine in which the ignition circuit includes a transformer having a secondary winding for generating a spark and having first and second primary windings. A capacitor is connected to the first primary winding to provide a high-energy capacitive discharge voltage to the transformer. A voltage regulator is connected to the secondary primary winding for generating an alternating current voltage. A control circuit is connected to the capacitor and to the voltage generator for providing control signals to discharge the high-energy capacitive discharge voltage to the first primary winding and for providing control signals to the voltage generator so as to generate an alternating current voltage.

U.S. Pat. No. 4,998,526, issued on Mar. 12, 1991 to K. P. Gokhae, teaches an alternating current ignition system. The system applies alternating current to the electrodes of a spark plug to maintain an arc at the electrodes for a desired period of time. The amplitude of the arc current can be varied. The alternating current is developed by a DC-to-AC inverter that includes a transformer that has a center-primary and a secondary that is connected to the spark plug. An arc is initiated at the spark plug by discharging a capacitor to one of the winding portions at the center-primary. Alternatively, the energy stored in an inductor may be supplied to a primary winding portion to initiate an arc. The ignition system is powered by a controlled current source that receives input power from a source of direct voltage, such as a battery on the motor vehicle.

In each of these prior art patents, the devices used dual mechanisms in which a high-energy discharges were supplemented with a low-energy extending mechanism. The method of extending the arc, however, presents problems to the end-user. First, the mechanism is, by nature, electronically complex in that multiple control mechanisms must be present either in the form of two separate arc mechanisms. Secondly, no method is presented for automatically sustaining the arc under a condition of repeated interruptions. Additionally, these mechanisms do not necessarily provide for a single functional-block unit of low mass and small size which contains all of the necessary functions within.

U.S. Pat. No. 6,135,099, issued on Oct. 24, 2000 to T. Marrs, discloses an ignition system for an internal combustion engine that comprises a transformer means having a primary winding adapted to be connected to a power supply and having a secondary winding adapted be connected to a spark plug. The transformer serves to produce an output from the secondary winding having a frequency of between 1 kHz and 100 kHz and a voltage of at least 20 kV. A controller is connected to the transformer so as to activate and deactivate the output of the transformer means relative to the combustion cycle. The transformer serves to produce the output having an alternating current with a high-voltage sine wave reaching at least 20 kV. A voltage regulator is connected to the power supply into the transformer so as to provide a constant DC voltage input to the transformer. The transformer produces power of constant wattage from the output of the secondary winding during the activation by the controller. The controller is connected to the transformer so as to allow the transformer to produce an arc of controllable duration across the electrode of the spark plug. This duration can be between 0.5 milliseconds and 4 milliseconds. A battery is connected the primary winding of the transformer. The battery produces a variable voltage of between 5 and 15 volts.

It is an object of the present invention to provide an ignition system which includes a transformer which is of a small enough size to be mounted directly on to the spark plug.

It is another object of the present invention to provide an ignition system which allows for simple radio frequency shielding so as to prevent radio frequency interference in the electrical system of the vehicle.

It is another object of the present invention to provide an ignition system which delivers constant wattage during the entire burn time.

It is another object of the present invention to provide an ignition system which enhances the ability to fire cold fuel at start-up.

It is a still another object of the present invention to provide an ignition system which delivers alternating current to the spark plug so as to greatly reduce spark plug gap erosion.

It is a further object of the present invention to provide an ignition system which provides for an adjustable arc duration on the electrode of the spark plug.

It is still another object of the present invention to provide an ignition system which can be used consistently and effectively with variable input voltage from the vehicle battery.

It is still a further object of the present invention to provide an ignition system which includes means for sensing the voltage and current at the output of the ignition module for the purpose of assessing conditions within the cylinder.

It is still a further object of the present invention to provide an ignition system which is easy-to-use, easy-to-manufacture and relatively inexpensive.

These and other objects and advantages of the present invention will become apparent from a reading of the attached specification and appended claims.

BRIEF SUMMARY OF THE INVENTION

The present invention is an ignition system for an internal combustion engine. The ignition system includes a power source, a transformer having first and second primary windings and a secondary winding, a connector extending from the secondary winding and adapted to connect with a terminal of the spark plug of the internal combustion engine, and an electronic spark timing circuit cooperative at the transformer so as to activate and deactivate voltage to the first and second primary windings. The first and second primary windings are connected to the power source such that the transformer produces an alternating voltage output from the secondary winding of between 1 kHz and 100 kHz and a voltage of at least 20 kV.

A forced push-pull inverter is cooperative with the electronic spark timing circuit so as to fix a frequency of current to the first and second primary windings. The fixed frequency is between 1 kHz and 100 kHz. The forced push-pull inverter includes an astable oscillator.

A gate-driven IC is cooperative with the electronic spark timing circuit so as to transmit voltage relative to a timing pulse of the electronic spark timing circuit. A first field effect transistor (FET) is connected to an output of the gate-driven IC. The first FET is switchable so as to transmit the alternating voltage to the first primary winding. A second FET is connected to an output of the gate driven IC. The second FET is switchable so as to transmit the alternating voltage to the second primary winding.

The engine control module passes a square wave of voltage to the electronic spark timing circuit. The electronic spark timing circuit produces a pulse off of the falling edge of the square wave. The square wave ranges from 0 volts to 5 volts. A spark is generated to the secondary winding from the electronic spark timing circuit when the square wave falls from 5 volts to 0 volts. The alternating voltage output of the secondary winding is a spark having an arc that has a continuous arc duration of between one-half millisecond and five milliseconds.

A voltage regulator circuit is electrically connected between the power source and the electronic spark timing circuit so as to step down voltage from the power source. The voltage regulator establishes a reference voltage of 8 volts. The gate-driven IC inverts voltage so as to ultimately cause the first FET and the second FET to fire alternately. A transient voltage suppressor is electrically connected between the power source and electronic spark timing circuit. In the present invention, the power supply includes a battery having a voltage of between 5 volts and 15 volts.

In accordance with a second aspect of the present invention, there is provided an ignition system for an internal combustion engine that includes a transformer having a primary winding adapted to be connected to a power supply and a secondary winding. The transformer produces an alternating voltage output from the secondary winding having a frequency of between 1 kHz and 100 kHz and a voltage of at least 20 kV. The transformer includes an oscillator-based push-pull inverter connected to the primary winding. A connector extends from the secondary winding of the transformer and is adapted to connect with a terminal of a spark plug of the internal combustion engine. A controller is interconnected to the transformer so as to activate and deactivate the output of the transformer.

In accordance with a third aspect of the present invention, there is provided an ignition system for an internal combustion engine that includes a transformer having a primary winding adapted to be connected to a power supply and a secondary winding. The transformer produces an output from the secondary winding of an alternating voltage having a frequency of between 1 kHz and 100 kHz. A single spark plug is connected to the secondary winding of the transformer. A controller is interconnected to the transformer so as to place the transformer in an active state and in an inactive state. The transformer passes the voltage to the single spark plug in the active state.

In accordance with a fourth aspect of the present invention, there is provided an ignition system for an internal combustion engine includes a battery, a voltage regulator connected to the battery and adapted to pass a constant DC voltage is an output therefrom, a plurality of transformers each having a primary winding on a secondary winding in which the primary winding is connected to the voltage regulator so as to receive constant DC voltage therefrom. A spark plug is connected to the secondary winding of each of the transformers. Each of the transformers serves to pass power of constant wattage to the spark plug.

In accordance with a fifth aspect of the present invention, there is provided an ignition system for an internal combustion engine that comprises a transformer having a primary winding adapted be connected to a power supply and has a secondary winding. A spark plug is connected to the secondary winding of the transformer. The spark plug has an electrode formed thereon so as to allow a spark to pass therefrom. The transformer passes voltage of at least 20 kV to the spark plug. The voltage that is passed to the spark plug by the transformer has an alternating voltage of between 1 kHz and 100 kHz. The controller is connected to the transformer. The controller places the transformer in an active state and in an inactive state. The active state corresponds to a duration of the spark across the electrode. This duration is between 0.5 milliseconds and 4 milliseconds.

In still a further aspect of the present invention, there is provided an ignition system for an internal combustion engine which includes a transformer having a primary winding adapted to be connected to a power supply and a secondary winding adapted to be connected to a spark plug. The transformer serves to produce an output from the secondary winding having a frequency of between 1 kHz and 100 kHz and a voltage of at least 20 kV.

A controller is connected to the transformer so as to activate and deactivate the output of the transformer relative to the combustion cycle. The transformer serves to produce the output having an alternating voltage with a high-voltage sine wave reaching at least 20 kV. A power-boost voltage regulator is connected to the power supply and to the transformer so as to provide a constant DC voltage input to the transformer. The transformer produces power of constant wattage from the output of the secondary winding during the activation by the controller. The controller is connected to the transformer so as to allow the transformer to produce an arc of controllable duration across the electrode of the spark plug. Ideally, this duration can be selected between 0.5 milliseconds and 4 milliseconds. A battery is connected to the input of the power-boost voltage regulator. The battery produces a variable voltage of between 5 and 15 V.

In the present invention, the secondary winding includes an output secondary winding having a connector extending therefrom. This output secondary winding can have, if desired, a current sensor attached thereto and connected to the controller so as to sense current through the output secondary winding. A sensing secondary winding can be, if desired, connected to the controller so as to sense a voltage of the output of the transformer. The transformer includes an inverter for converting the output to an alternating voltage. In the present invention, the specific inverter which is used as a form of push-pull oscillator inverter connected to the primary winding of the transformer. The power-boost voltage regulator in the present invention includes a switch regulator integrated circuit connected to an energy storage inductor and to a switching transistor. The switch regulator integrated circuit (IC) receives a variable voltage from the power supply or battery. The switch regulator IC provides a regulated voltage of between 15 and 50 volts to the transformer. A voltage input is connected to the switch regulator integrated circuit for reducing the fixed voltage with a proportional positive voltage.

In the preferred embodiment of the present invention, the transformer is directly connected to the spark plug. An electrical line will extend from the transformer to the controller which is mounted at a location away from the spark plug. The battery associated with the internal combustion engine has a power supply line extending to the ignition controller. The ignition controller will pass a regulated voltage from the battery to the transformer. The ignition controller can be in the nature of a series of digital/analog control circuits, microprocessor(s), custom-integrated circuits and associated discrete devices, or similar electronics.

The present invention offers a number of advantages over various prior art systems. The present invention utilizes a very small-sized high-voltage transformer. This is the result of the high frequency of the operation and the fact that the transformer boosts a relatively high voltage input rather than a battery input. The transformer can be small enough to mount directly on top of the spark plug so as to create a package several times smaller and lighter than conventional systems. This further allows for easy radio frequency shielding as well as preventing radio frequency interference in the electrical systems, as well as in the radio of the vehicle. The high-frequency operation allows for a smaller ferrite core and the high input voltage allows for a smaller turns ratio and consequently fewer turns of wire on the secondary. It is believed that the transformer can utilize a coil which is 1.25 inches in diameter of only 2.5 inches long.

The present invention delivers constant wattage during the entire arc duration or burn time. A normal ignition system fires with maximum wattage in the first 100 microseconds and then exponentially decays to zero. The present invention delivers enough voltage and power to re-fire an extinguished spark throughout the entire "on" time. This is of great benefit in firing cold fuel at start-up (cold starting) when the fuel is not warm enough to fully vaporize.

The present invention utilizes alternating current to the spark plug so as to greatly reduce spark plug gap erosion. Experience has shown that material is removed from the anode and deposited on the cathode, or vice versa, during the operation of normal ignition systems. The removal of material will depend upon the flow direction of the DC current in the spark plug gap. Under certain circumstances, spark plug gaps can erode from 20,000 volt gaps to 35,000 volt gaps over time in conventional systems.

In the present invention, the arc duration is controllably adjustable from between 0.5 milliseconds to 4 milliseconds by simply changing a timing resistor/capacitor or discharge rate, or changing during the duration of the electronic spark timing input timing signal itself. In actual application, the arc duration can be 4 milliseconds during cold starting and reduced to 0.5 milliseconds during normal operation. Additional timer circuits can also be used so as to produce multiple AC bursts for a given electronic spark timing input signal, as desired. This serves to reduce spark plug wear and reduce the power requirements on the batteries. This adjustment can be done automatically by the controller in relation to engine temperature or other input variables. The power boost voltage regulator provided in the present invention allows the present invention to operate satisfactorily over a range of 5 volts to 15 volts of input. This variable input voltage is the result of the use of conventional automotive batteries.

This foregoing Section is intended to describe, with particularity, the preferred embodiments of the present invention. It is understood that variations to these preferred embodiments can be made within the scope of the present claims. As such, this Section should not be construed as limiting of the broad scope of the present invention. The present invention should only be limited by the following claims and their legal equivalents.

DETAILED DESCRIPTION OF THE INVENTION

Figure 1:
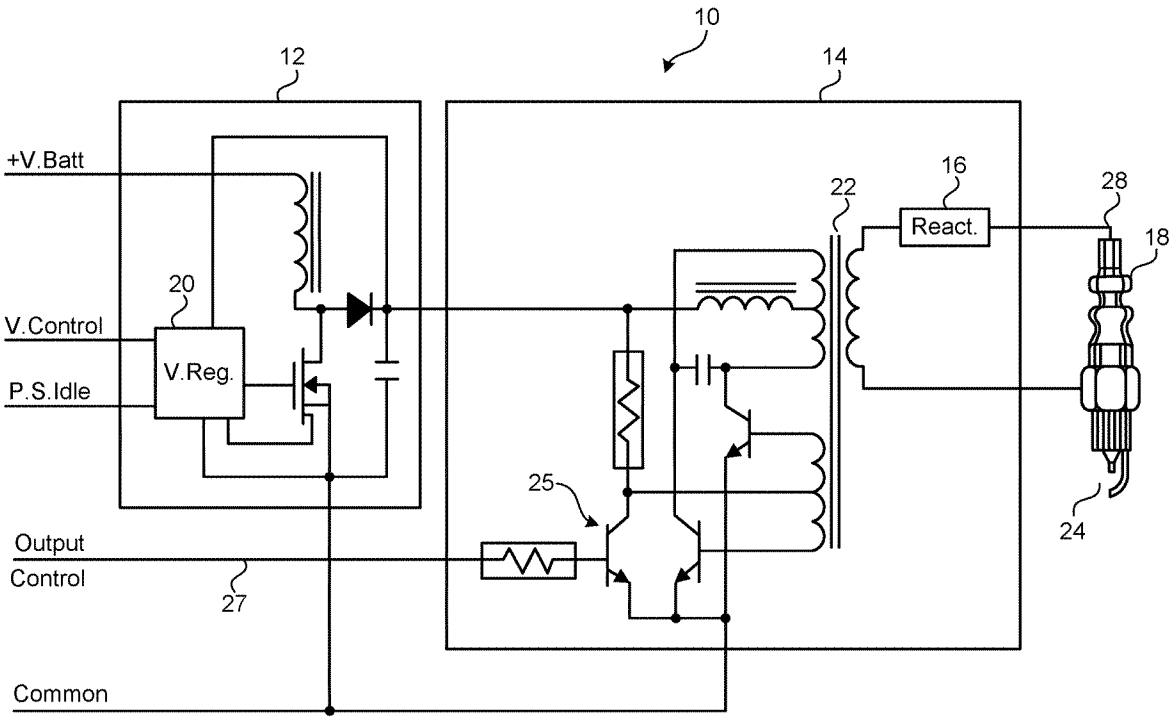
FIG. 1 is a block diagram, with appropriate connection shown, of a preferred embodiment of the present invention.

Referring to FIG. 1, there is shown the ignition system 10 in accordance with the preferred embodiment of the present invention. The ignition system 10 includes a pair of functional groups. The first functional group 12 is the power boost voltage regulator circuit. The second functional group 14 is the output section. The second group 14 produces the high-voltage AC output which is current limited by a ballasting reactance 16. Functional groups 12 and 14 act together so as to appropriately fire the spark plug 18. The functional group 12 is the input power boost voltage regulator. Functional group 12 provides a feedback-controlled regulated DC supply to the second group 14 so as to permit the deployment of the present invention in engine systems with varying input DC supply voltage voltages without adjustment. The input power boost voltage regulator 12 may additionally incorporate suitable means to reduce the output voltage when advisable and go into idle mode to reduce total module current draw from the engine primary DC power supply.

The second functional group 14 produces the high-voltage AC output supplied to the spark plug 18. The ballasting resistance can be a lumped-element capacitor, a lumped-element conductor, or a distributed inductance comprised of the leakage inductance of the output transformer 22. In each such case, the intent and effect is to limit output current once an arc has been established across the spark plug electrodes 24 permitting the output voltage to develop across the electrodes 24 when the open circuit (no arc) condition occurs.

One of the important benefits provided by this action is the property of immediately reestablishing the arc (typically within one quarter-cycle of the inverter frequency) should it be interrupted by conditions within the combustion chamber. The second functional group 14 also contains an electronic spark timing pulse timer 25 for controlling the output. The circuit idles the output section when the control input 27 (EST input) is in the idle state and permits operation when the control input 27 is in the active state. The output control 25 can also contain circuitry intended to increase ignition timing accuracy. In the present invention, the second functional group 14 provides a DC-to-AC inverter with high-voltage at the output terminal 28 with output current limiting inherent in the characteristics of the circuit. It provides for sustaining the arc under all normal conditions for minimal electrical wear on the spark plug electrodes 24 within the cylinder. The output of the second functional group 14 (i.e. the oscillator timer) is set in the lower frequency (RF) band (1 kHz to 100 kHz) for the purposes of rapid electrical action and minimization of size. The present invention, by utilizing high frequencies, can provide low mass, compactness, unitary functionality, and rapid buildup of output voltage at turn-on with high electrical efficiency during sustained arcing. The present invention thus serves both distributor-type ignition systems and coil-near-plug systems, or coil-on-plug systems.

The present invention utilizes a DC-to-AC high-voltage, high-frequency inverter which is reactively current limited at the output in which contains a means by which the inverter may be activated and idled by a low voltage signal from the electronic spark timing circuit, such as is to be expected from an engine controller (whether analog or digital). The present invention also utilizes such controllable inverters with the addition of a power boost supply whereby DC power to the controllable inverter may be constant over a specific range of primary supply voltages. The present invention can also include such controllable inverters with regulated power supplies wherein the regulated DC supply to the inverter may be controlled over a specific range of DC output voltages by an external control input to the regulated supply. The present invention can also comprise such controllable inverters with a power supply providing external control inputs wherein the power supply is placed in an idle mode by means of an external control input so as to reduce the power drain from the primary power supply. The present invention also can comprise such controllable inverters with power supplies providing external control inputs for voltage and/or shut down with timers in the inverter controller circuitry such that time delay in the initiation of the arc due to the time required for the inverter to reach full operation is minimized and/or compensated in order to provide accurate ignition timing to the controlled engine. The present invention can also comprise controllable inverters with controllable regulated power supplies and timing-compensated inverter controllers having additional means whereby the voltage across the output terminals and/or the current to the output terminals may be sensed while the inverter is in operation, as desired.

Figure 2:
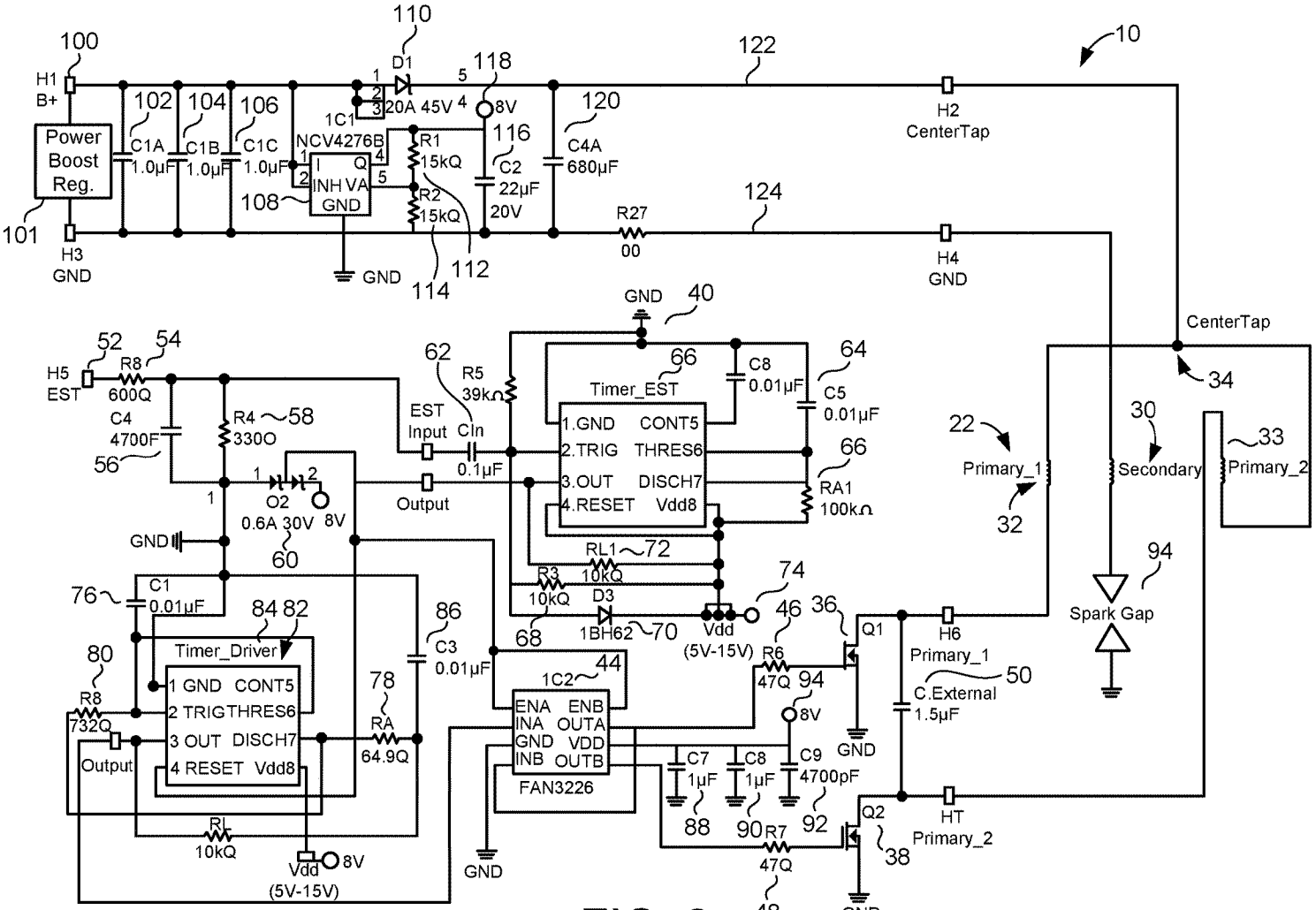
FIG. 2 is a schematic diagram of the electronics associated with the circuitry of the ignition system of the present invention.

FIG. 2 is a detailed electrical schematic of the operation of the ignition system of the present invention. It is to be understood that the specific circuit topology shown in FIG. 2, while sufficient to achieve the functionality of the present invention, should not limit, in anyway, the scope of the present invention with respect to the specific circuitry, devices or circuit models contained therein. The present invention is, in each of the functions comprising its whole, is realizable by way of several different circuit topologies, models and theories of operation. It is further understood that the use of several different makes, models, technologies, and types of electronic components in each of the crucial active-device positions in any particular circuit topology chosen can also achieve the desired function.

Referring generally to FIG. 2, the ignition system 10 of the present invention is shown in schematic form. The ignition system of the present invention includes an output transformer 22. Output transformer 22 can be a gapped magnetic ferrite ceramic core transformer configured so as to provide partial decoupling of the primary and secondary windings. This constitutes the output current limiting reactants in the form of the secondary winding 30 leakage inductance. The primary windings 32 and 33 have a center tap 34 and switching transistors 36 and 38 connected to each end terminal.

In general, and electronic spark timing (EST) control signal is provided by the engine controller which is conditioned and used to activate an RC-controlled mono-stable oscillator. This mono-stable oscillator 40 is used to control the timing of the electronic spark timing circuit 42 along with the arc duration. The arc duration will be between 0.5 milliseconds to 5 milliseconds. The same timing pulse from the mono-stable oscillator 40 is then used to activate or enable a frequency astable oscillator or timer circuit and enable a buffered FET gate driver integrated circuit. As mentioned above, the second timer is configured as an astable oscillator that is configured to provide about 1 kHz to 100 kHz (a 0 volt to 8 volt signal) and is used to provide a first gate drive signal to the inverting input of the gate driver integrated circuit 44. The first output of the gate driver integrated circuit 44 is then used to drive the first FET 36. In addition, this first gate drive output is then connected to the second inverting input of the gate driver integrated circuit 44. This guarantees the necessary out-of-phase gate drive timing to the second FET 38. The combination of these timers and gate driver integrated circuits are used to produce the switching signals to the N channel enhancement mode switching transistors 36 and 38 from the gate drive bias resistors 46 and 48. The primary winding 32 is bridged by a capacitor 50 (external) so as to form a resonant tank circuit. This entire circuit is in the form of a push-pull inverter. The oscillator is disabled by means of the EST mono-stable output returning to 0 volts at the end of the 0.5 millisecond to 5 millisecond desired timing pulse.

At start-up, the oscillator 40 is commanded on by the engine controller's EST signal. The resonant tank having the capacitor 50 and the primary winding 32 are driven or switched at a commanded frequency to deliver maximum power to the output of the transformer 32. Amplitude oscillation will continue as long as power and bias are available to switching transistors 36 and 38. The push-pull inverter circuit is thus self-starting and self-sustaining. Specifically, referring to FIG. 2, power is initially provided through an EST input 52 toward a resistor 54. Resistor 54 serves to level shift the input for the EST 42. As such, it serves as a voltage divider. Capacitor 56 is a filter capacitor for EST 42. Resistor 58 is for input current sinking to the EST 42. A voltage transient suppression diode 60 is clamped to the eight volt power supply output from the voltage regulator and serves to suppress transients in the voltage being transmitted to the EST 42. An input capacitor 62 is provided along the pathway from the EST input 52 to the trigger terminal of the EST 42. The mono-stable oscillator 40 will extend through pins 1 and 8 of the EST 42. The capacitor 64 and the resistor 66 establish the pulse duration for the alternating voltage for an arc of approximately 1.1 milliseconds. Resistor 68 and diode 70 provide the input threshold trigger. Resistor 72 is a pull-up output resistor to $V_{dd}$ to provide output drive control. Ultimately, the enable pulse will emanate from the EST input 52 of the engine control module (ECM) so as to be transmitted to the trigger pin of the EST 42. Capacitor and resistors 76, 78 and 80 are used to establish the frequency of the base astable oscillator 82. The astable oscillator 82 provides for a fixed frequency of between 1 kHz and 100 kHz. As such, it serves as a force push-pull inverter so as to force the frequencies of the present invention. The pin 4 of the timer driver IC 84 is provided an enable pulse from pin 3 that passes to the EST 42 output. Capacitor 86 is a filter capacitor that is used to filter $V_{dd}$ noise spikes. Enable pins 1 and 8 of the gate driver IC 44 are used to wake up the gate-driver IC 44 for about one millisecond pulse. The IC 44 is enabled by the pin 3 output of EST 42. Capacitors 88, 90 and 92 are storage capacitors for the gate driver outputs. The power supply 94 will supply eight volts of power from the voltage regulator circuit. As such, the gate-drive IC 44 can alternately bias the FETs 36 and 38 so as to drive the respective primary windings 32 and 33. The capacitor 50, stated hereinbefore, helps to establish the resonate frequency. Ultimately, the voltage will flow as a sinusoidal voltage to each of the primaries 32 and 33. As a result, the transformer 22 will have the primaries 32 and 34 biased alternately so as to create a high-voltage output from the secondary 30. The system of the present invention assures that the FETs 36 and 38 are not on at the same time. As such, each will have nearly a 50% duty cycle during the arcing of the secondary 30 across the spark plug gap 94.

The power supply initially comes from the battery 100. An optional power boost voltage regulator 101 can be provided in association with the power supply from battery 100. This power boost voltage regulator is shown in greater detail in FIG. 4. Filter capacitors 102, 104, and 106 are provided so as to filter the transients from the battery voltage. The IC 108 is a voltage regulator that provides power to the timers of the EST 42 into the gate driver IC 44. Diode 110 is a blocking diode for reverse battery protection. Resistors 112 and 114 serve to set the voltage reference to eight volts. Capacitor 116 is a storage capacitor for the voltage regulator. Ultimately, the eight volts created by the voltage regulator will be supplied to 118. Capacitor 120 is a storage/stability capacitor for the primary side voltage. Line 122 will extend to the center tap 34. Line 124 will extend to the secondary 30. The eight volts shown at 118 is supplied to the lower part of the schematic in those areas indicated as 8V.

In the present invention, a sensing secondary winding can be provided so as to permit feedback to an engine control unit with respect to the voltage on the output secondary winding 30, if desired. The output secondary winding 30, if desired, can have its lower terminal connected to a current sensor, such as a resistor and diode. This will permit feedback to the engine controller unit with respect to the current through the output secondary winding 30.

The power boost regulator voltage circuit, as shown as functional group 12 of FIG. 1, and in the upper portion of the schematic of FIG. 2, provides a regulated voltage to the inverter in the range of 15 to 50 volts, depending on the integrated circuit chosen and the ratio of the feedback resistors. An input may be provided for reducing the regulated voltage with a proportional positive voltage. The amount of the reduction may be controlled by adjusting the value of the resistors. A control input can be provided to put the switching regulator into an idle mode to the action of a pull-down transistor. The primary power inlet from the battery is protected from load dump surges and spikes by surge-absorbing diode.

In the present invention, is preferable that the voltage from the battery be boosted so that the 5 to 15 volts from the battery turns into 15 to 50 volts for the push/pull inverter. This would reduce the need for a high turns ratio in the transformer 22. As such, with such increase in voltage, the size of the transformer 22 can be suitably reduced.

The signal to the spark plugs from the EST 42 is a low voltage square wave that can be configured, as desired, to turn the circuit on when the spark should fire and off when the engine does not require a spark. This can be varied so as to provide longer "arc duration" during cold starting and shorter during normal operation. The circuitry of the present invention can utilize a filter to block radio frequencies from the DC power supply. This can be a small ferrite toroid and a filter capacitor.

The push-pull inverter used in the present invention, together with the primary windings of the transformer, forms an oscillator with the winding 32 during one-half cycle of the sine wave output and with winding 33 during the other half of the sine wave output. Suitable capacitors can be used so as to help set the desired oscillation frequency, along with the primary inductance and secondary leakage inductance in order to deliver maximum power. The output of the transformer 22 is a high-voltage sine wave that reaches at least +/−20 kV (0-to-peak). The preferred operating frequency is in the range of 10 kHz to 100 kHz.

The transformer 22 can take various shapes. One preferred type of transformer 22 would include a ferrite core (gapped in the center leg), a primary winding having eight turns center tap of 18 gauge magnet wire, and a section bobbin secondary having approximately 10,000 turns of 40 gauge magnet wire. The transformer 22 can be potted in a high-voltage potting material. The circuit associated with the transformer 22 can be potted in the same shielded enclosure.

Figure 3:
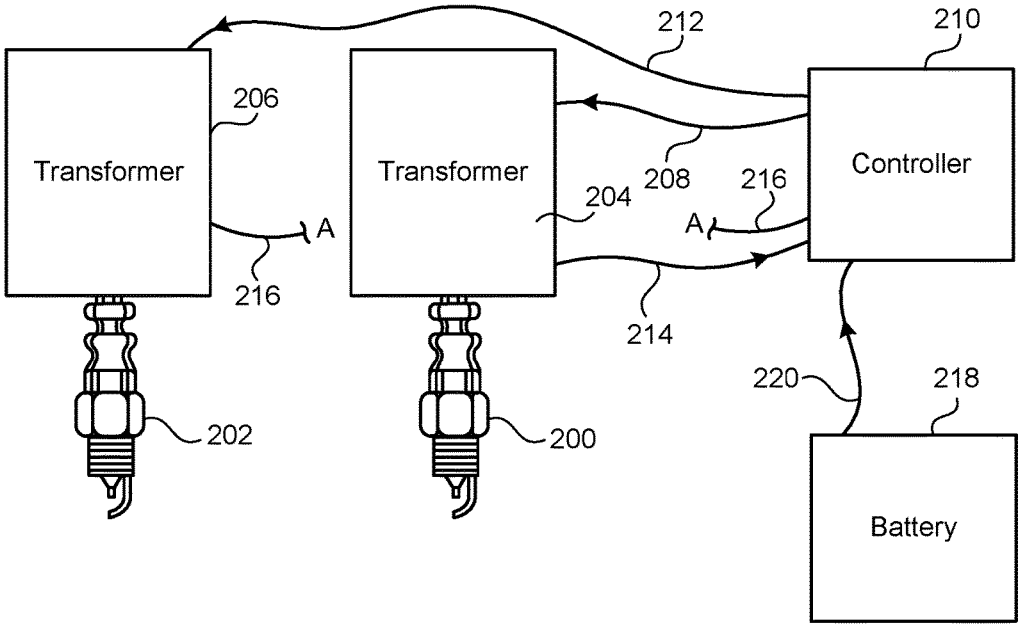
FIG. 3 is a block diagram showing the application of the system of the present invention to spark plugs of a motor vehicle.

FIG. 3 is a diagrammatic illustration showing the ignition system of the present invention as used directly in association with spark plugs 200 and 202. In FIG. 3, it can be seen that the transformer 204 is directly connected onto the spark plug 200. Similarly, the transformer 206 is directly connected onto the spark plug 202. An electrical line 208 will extend from the controller 210 to the transformer 204. Another electrical line 212 will extend from the controller 210 to the transformer 206. As such, the controller 210 can provide the necessary timing signals to the transformers 204 in 206 for the firing of the spark plugs 200 and 202, respectively.

Similarly, the transformer 204 includes a sensor line 214 extending back to the controller 210. The transformer 206 also includes a sensor line 216 extending back to the controller 210. As such, controller 210 can receive suitable signals from the transformers 204 in 206 as to the operating conditions of the spark plugs 200 and 202 for a proper monitoring of the output current output voltage of the secondary winding. By providing this information, the controller 210 can be suitably programmed to optimize the firing of the spark plugs 200 and 202 in relation to items such as engine temperature and fuel consumption. The automotive battery 218 is connected by line 220 so as to provide power to the controller 210.

As can be seen in FIG. 3, unlike conventional ignition coils, the firing of each of the spark plugs 200 and 202 is carried out directly on the spark plugs. The engine controller 210 can be a microprocessor which is programmed with the necessary information for the optimization of the firing of each of the spark plugs. The engine controller 210 can receive inputs from the crankshaft or from the engine as to the specific time at which the firing of the combustion chamber of each of the spark plugs 200 and 202 is necessary. Since each of the transformers 204 and 206 are located directly on the spark plugs 200 and 202, and since they operate at low frequencies, radio interference within the automobile is effectively avoided. Suitable shielding should be applied to each of the transformers 204 and 206 further guard against any RF interference.

Within the system of the present invention, the 12 volt input is nominally the voltage of battery 218. This can vary from 6 volts at cold cranking to 14.5 or 15 volts during normal operation. The output voltage and energy of the high-voltage transformer is proportional to the input voltage. As such, is necessary to provide enough voltage and energy with 6 volts of input to start the vehicle during low voltage conditions, such as cold starting.

Figure 4:
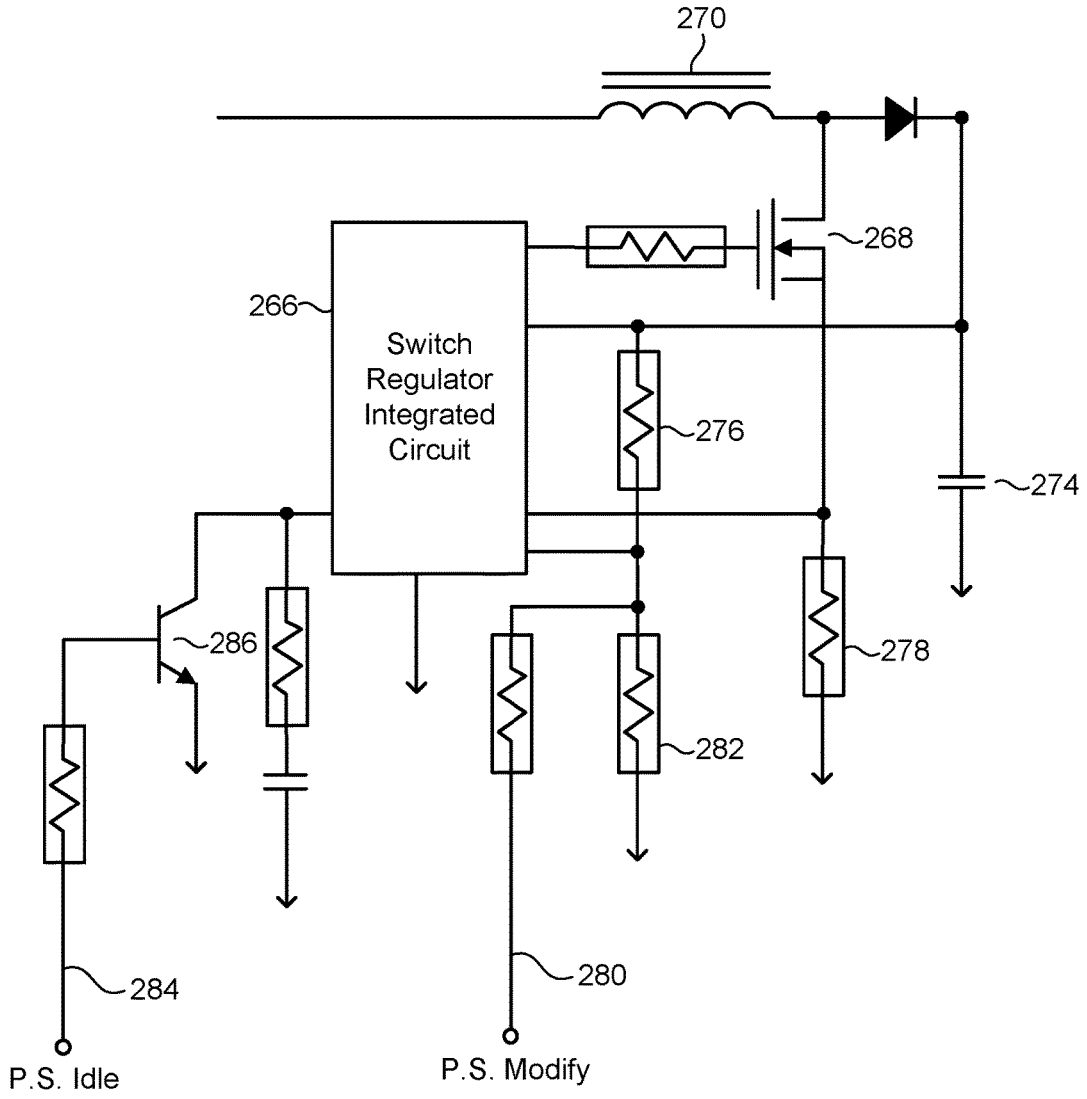
FIG. 4 is a schematic diagram of the optional power boost voltage regulator as used with the power supply.

Referring to FIG. 4, the optional power boost voltage regulator 101, as illustrated in FIG. 2, is illustrated. This power boost voltage regulator 101 includes a switch regulator integrated circuit 266, a switching transistor 268, and energy storage inductor 270, an input filter capacitor 272 and an output filter capacitor 274. The circuit provides a regulated voltage to the inverter in the range of 15 to 50 volts, depending on the integrated circuit 266 that is chosen and the ratio of feedback resistors 276 and 278. An input 280 may be provided for reducing the regulated voltage with a proportional positive voltage. The amount of the reduction may be controlled by adjusting the value of the resistor 282. A control input 284 is provided for putting the switch regulator integrated circuit 266 into an idle mode through the action of pull-down transistor 286. The primary power inlet 288 from the battery is protected from load dump surges and spikes by a surge-absorbing diode 290.

In the present invention, would be preferable that the voltage from the battery be boosted so that the 5 to 15 volts from the battery turns into 15 to 50 volts for the inverter. This would reduce the need for a high turns ratio in the transformer. As such, with such an increase in voltage, the size of the transformer can be suitably reduced.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An ignition system for an internal combustion engine comprising:

a power source;

a transformer having a first primary winding and a second primary winding and a secondary winding, said first and second primary windings connected to said power source such that said transformer produces an alternating voltage output from said secondary winding of between 1 kHz and 100 kHz and a voltage of at least 20 kv;

a connector extending from said secondary winding, said connector adapted to connect with a terminal of a spark plug of the internal combustion engine;

an electronic spark timing circuit cooperative with said transformer so as to activate and deactivate a voltage to said first and second primary windings; and a forced push-pull inverter cooperative with said electronic spark timing circuit so as to directly fix a frequency of voltage to said first and second primary windings.

2. The ignition system of claim 1, the fixed frequency being between 1 kHz and 100 kHz.

3. The ignition system of claim 1, said forced push-pull inverter comprising an astable oscillator.

4. The ignition system of claim 1, further comprising:

an inverting gate-driver IC cooperative with said electronic spark timing circuit so as to transmit voltage relative to a timing pulse of said electronic spark timing circuit;

a first field effect transistor connected to an output of said gate-driver IC, said first field effect transistor being switchable so as to transmit the alternating voltage to said first primary winding; and a second field effect transistor connected to an output of said gate-driver IC, said second field effect transistor being switchable so as to transmit the alternating voltage to said second primary winding.

5. The ignition system of claim 1, said alternating voltage output of said secondary winding being a spark having a continuous arc duration of between 0.5 millisecond and 5 milliseconds.

6. The ignition system of claim 1, further comprising:

a voltage regulator circuit electrically connected between said power source and said electronic spark timing circuit so as to step down voltage from said power source.

7. The ignition system of claim 6, said voltage regulator establish a reference voltage of approximately 8 volts.

8. The ignition system of claim 4, said gate-driver IC inverting voltage so as to cause said first field effect transistor and said second field effect transistor to bias alternately.

9. The ignition system of claim 1, further comprising:

a transient voltage suppressor electrically connected between said power source and said electronic spark timing circuit.

10. The ignition system of claim 1, said power supply comprising:

a battery having a voltage between 5 volts and 15 volts.

11. An ignition system for an internal combustion engine comprising:

a power source;

a transformer having a first primary winding and a second primary winding and a secondary winding, said first and second primary windings connected to said power source such that said transformer produces an alternating voltage output from said secondary winding of between 1 kHz and 100 kHz and a voltage of at least 20 kv;

a connector extending from said secondary winding, said connector adapted to connect with a terminal of a spark plug of the internal combustion engine;

an electronic spark timing circuit cooperative with said transformer so as to activate and deactivate a voltage to said first and second primary windings, said electronic spark timing circuit passing a square wave of voltage to said electronic spark timing circuit, said electronic spark timing circuit producing a voltage pulse off of a falling edge of the square wave.

12. The ignition system of claim 11, said square wave ranging from 0 volts to 5 volts, a spark being generated to said secondary winding from said electronic spark timing circuit when the square wave falls from 5 volts to 0 volts.

13. An ignition system for an internal combustion engine comprising:

a power source;

a transformer having a first primary winding and a second primary winding and a secondary winding, said first and second primary windings connected to said power source such that said transformer produces an alternating voltage output from said secondary winding of between 1 kHz and 100 kHz and a voltage of at least 20 kV;

a connector extending from said secondary winding, said connector adapted to connect with a terminal of a spark plug of the internal combustion engine;

an electronic spark timing circuit cooperative with said transformer so as to activate and deactivate voltage to said first and second primary windings;

a forced push-pull inverter cooperative with said electronic spark timing circuit so as to fix a frequency of voltage to said first and second primary windings, said electronic spark timing circuit passing a square wave of voltage to said electronic spark timing circuit, said electronic spark timing circuit producing a voltage pulse off of a falling edge of the square wave;

an inverting gate-driver IC cooperative with said electronic spark timing circuit so as to transmit voltage relative to a timing pulse of said electronic spark timing circuit;

a first field effect transistor connected to an output of said inverting gate-driver IC, said first field effect transistor being switchable so as to transmit the alternating voltage to said first primary winding; and a second field effect transistor connected to an output of said inverting gate-driver IC, said second field effect transistor being switchable so as to transmit the alternating voltage to said second primary winding.

14. The ignition system of claim 13, said alternating voltage output of said secondary winding being a spark having a continuous arc duration of between 0.5 millisecond and 5 milliseconds.

15. The ignition system of claim 13, further comprising:

a voltage regulator circuit electrically connected between said power source and said electronic spark timing circuit so as to step down voltage from said power source.

16. The ignition system of claim 13, said gate-driver IC inverting voltage so as to cause said first field effect transistor and said second field effect transistor to bias alternately.

17. The ignition system of claim 13, said power supply comprising:

a battery having a voltage of between 5 volts and 15 volts.

* * * * *